US009699860B2

(12) United States Patent
Hayashi et al.

(10) Patent No.: US 9,699,860 B2
(45) Date of Patent: Jul. 4, 2017

(54) LIGHT EMITTING MODULE AND ILLUMINATION DEVICE USING THE SAME

(71) Applicant: Panasonic Intellectual Property Management Co., Ltd., Osaka (JP)

(72) Inventors: Yohei Hayashi, Osaka (JP); Osamu Tanahashi, Kyoto (JP); Hideharu Kawachi, Hyogo (JP); Masanao Okawa, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 175 days.

(21) Appl. No.: 14/615,728

(22) Filed: Feb. 6, 2015

(65) Prior Publication Data

US 2015/0230317 A1 Aug. 13, 2015

(30) Foreign Application Priority Data

Feb. 13, 2014 (JP) ..... 2014-025963

(51) Int. Cl.

| | |
|---|---|
| ***H05B 33/14*** | (2006.01) |
| ***F21V 23/06*** | (2006.01) |
| ***F21V 19/04*** | (2006.01) |
| *F21S 4/28* | (2016.01) |
| *F21S 2/00* | (2016.01) |
| *F21V 21/005* | (2006.01) |
| *F21Y 113/00* | (2016.01) |

(Continued)

(52) U.S. Cl.

CPC ..... *H05B 33/14* (2013.01); *F21V 19/04* (2013.01); *F21S 2/00* (2013.01); *F21S 4/28* (2016.01); *F21V 21/005* (2013.01); *F21V 23/06* (2013.01); *F21Y 2105/00* (2013.01); *F21Y 2113/00* (2013.01); *F21Y 2115/20* (2016.08)

(58) Field of Classification Search

CPC ..... H05B 33/14; F21S 4/008; F21V 23/06

See application file for complete search history.

(56) References Cited

U.S. PATENT DOCUMENTS

2006/0087843 A1* 4/2006 Setomoto ..... H05B 33/0803 362/249.01

2013/0279181 A1 10/2013 Kawachi et al.

FOREIGN PATENT DOCUMENTS

JP 2009-146646 A 7/2009

JP 2011-222225 A 11/2011

(Continued)

*Primary Examiner* — Elmito Breval

(74) *Attorney, Agent, or Firm* — Renner, Otto, Boisselle & Sklar, LLP

(57) ABSTRACT

A light emitting module includes light source units having a rectangular plate shape, and a base unit having an elongated rectangular plate shape. The light source units are disposed along a straight line and removably mounted to the base unit. Each of the light source units includes a pair of engaging portions used in bringing each of the light source units into engagement with the base unit. The engaging portions are disposed in two opposite sides of a mounting surface of each of the light source units to be mounted to the base unit. The base unit includes holding portions provided along a longitudinal direction of the base unit on an attachment surface of the base unit to which the light source units are attached and holding-portion-attachment portions to which the holding portions are detachably attached at a predetermined interval along the longitudinal direction of the base unit.

16 Claims, 10 Drawing Sheets

(51) Int. Cl.
*F21Y 105/00* (2016.01)
*F21Y 115/20* (2016.01)

(56) References Cited

FOREIGN PATENT DOCUMENTS

| | | | |
|---|---|---|---|
| JP | 2012-48982 | A | 3/2012 |
| JP | 2012-104504 | A | 5/2012 |
| JP | 2012-199219 | | 10/2012 |
| JP | 2013-183139 | A | 9/2013 |

* cited by examiner

LIGHT EMITTING MODULE AND ILLUMINATION DEVICE USING THE SAME

CROSS-REFERENCE TO RELATED APPLICATION

This application claims priority to Japanese Patent Application No. 2014-025963 filed on Feb. 13, 2014, the entire contents of which are incorporated herein by reference.

TECHNICAL FIELD

The present disclosure relates to a light emitting module which uses an organic EL (Electro-Luminescence) element as a light source, and an illumination device using the same.

BACKGROUND ART

An organic EL element is a flat light emitting element capable of emitting high-brightness light at a low voltage and capable of obtaining different light emission colors depending on the kind of organic compounds contained therein. As a light emitting module using such an organic EL element, there is known a light emitting module that includes a plurality of planar light sources (light source units) using an organic EL element as a light source and a support member (base unit) configured to support the planar light sources (see, e.g., Japanese Unexamined Patent Application Publication No. 2012-104504).

However, in the aforementioned light emitting module, the mounting positions of the light source units to the base unit are limited. It is therefore impossible to dispose the light source units at arbitrary locations.

SUMMARY OF THE INVENTION

In view of the above, the present disclosure provides a light emitting module which includes light source units using an organic EL element as a light source and which makes it possible to easily and accurately dispose the light source units at arbitrary locations.

In accordance with an aspect of the present invention, there is provided a light emitting module, including: a plurality of light source units having a rectangular plate shape; and a base unit having an elongated rectangular plate shape, the light source units disposed along a straight line and removably mounted to the base unit, wherein each of the light source units includes a pair of engaging portions used in bringing each of the light source units into engagement with the base unit, the engaging portions disposed in two opposite sides of a mounting surface of each of the light source units to be mounted to the base unit, at least one of the engaging portions is slidable toward the other engaging portion, and the base unit includes a plurality of holding portions provided along a longitudinal direction of the base unit on an attachment surface of the base unit to which the light source units are attached and a plurality of holding-portion-attachment portions to which the holding portions are detachably attached at a predetermined interval along the longitudinal direction of the base unit.

Each of the light source units may further includes terminals erected from the mounting surface in an adjoining relationship with the engaging portions and used in supplying electric power to each of the light source units and inputting a control signal to each of the light source units, the base unit further includes a plurality of connectors electrically connected to the terminals and detachably attached to the holding-portion-attachment portions, and the connectors are provided adjacent to the light source units and disposed in boundary positions between the light source units when the light source units are mounted to the base unit in an adjoining relationship with each other, and the connectors interconnect the terminals of the light source units adjoining each other.

The holding portions may be unified with each of the connectors.

Each of the terminals may have a shape of a flat blade extending in a slide direction of the engaging portions, each of the connectors has terminal insertion holes into which the terminals are inserted, and the terminal insertion holes are formed so as to extend along the longitudinal direction of the base unit.

The terminals may be disposed at the sides of each of the light source units in which the engaging portions are provided.

The terminals may be composed of three pole terminals which include an anode terminal and a cathode terminal used in supplying electric power to each of the light source units and a signal terminal used in inputting a control signal to each of the light source units, and in each of the light source units, the arrangement of the three pole terminals existing in one side and an arrangement of the three pole terminals existing in the other side are in point symmetry with respect to a center of the mounting surface.

The connectors may be attached to the terminals before the light source units are mounted to the base unit.

The holding portions and the connectors may be separately provided.

An illumination device may include the light emitting module described above.

With such a configuration, the holding portions for holding the light source units are detachably attached to arbitrary holding-portion-attachment portions of the base unit. Therefore, by changing the arrangement of the holding portions, it is possible to easily and accurately dispose the light source units at arbitrary locations.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Figure 1A:
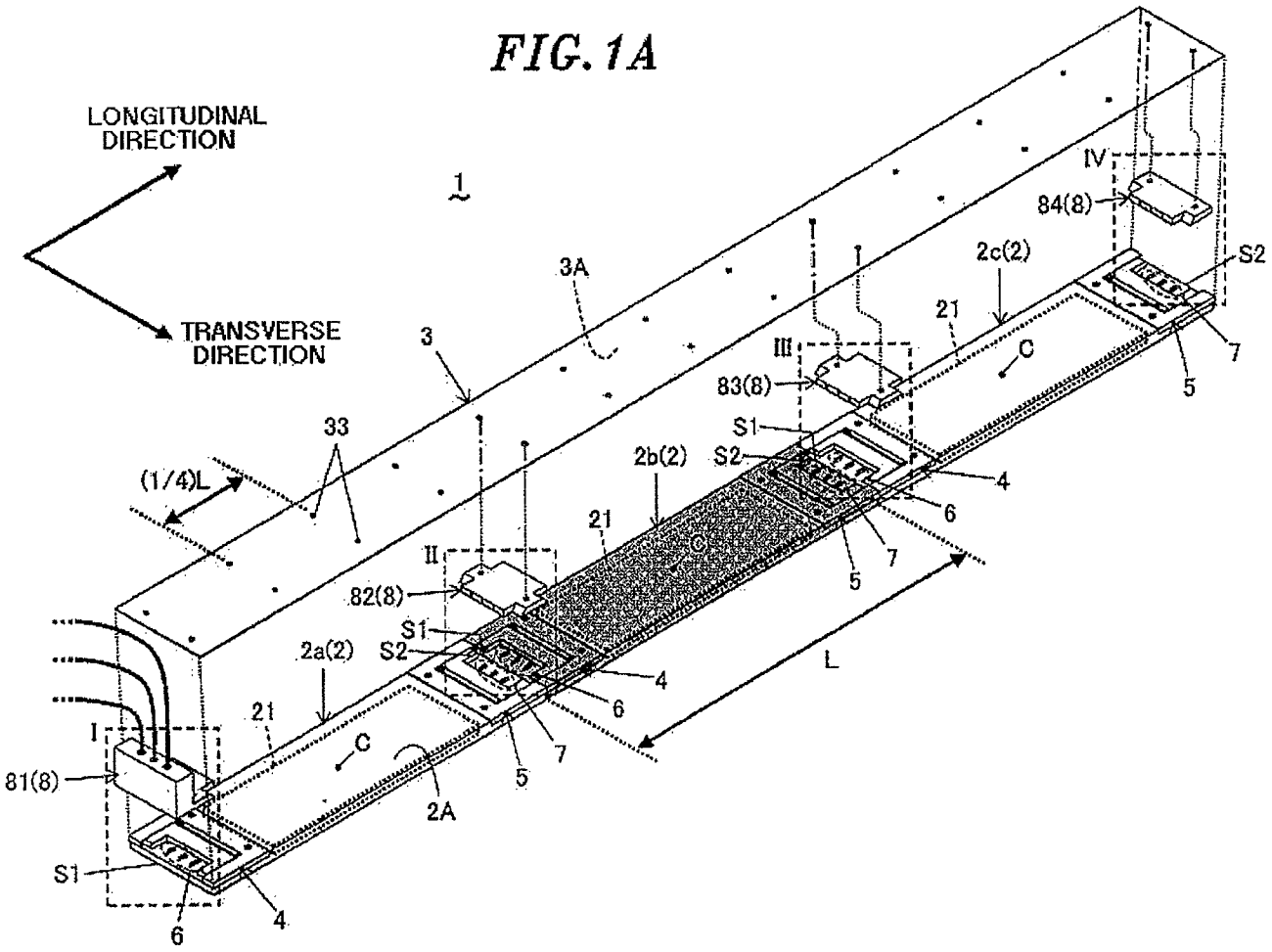
FIG. 1A is an exploded perspective view of a light emitting module according to one embodiment of the present invention.
Figure 1B:
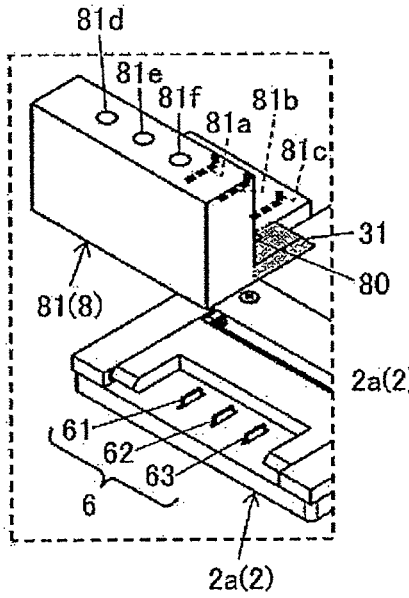
FIGS. 1B to 1E are respectively enlarged views of regions I to IV indicated in FIG. 1A.
Figure 1C:
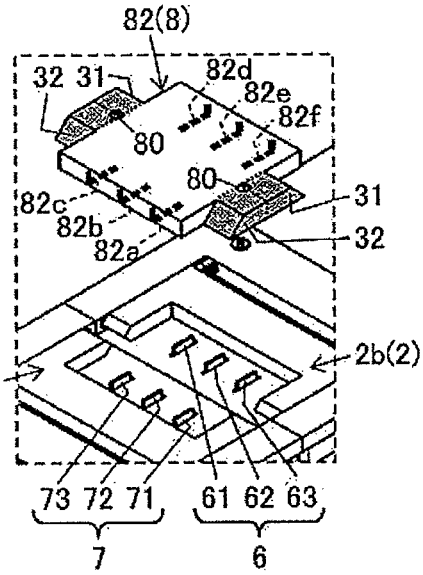
Figure 1D:
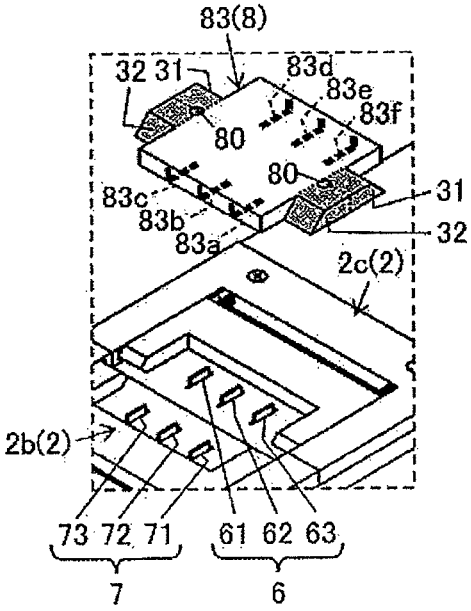
Figure 1E:
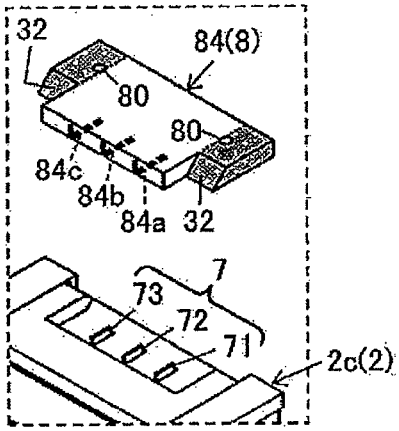

A light emitting module according to one embodiment of the present invention will now be described with reference to FIGS. 1A to 6. The present light emitting module constitutes an illumination device used in households, stores, etc.

As shown in FIGS. 1A to 1E, the light emitting module 1 includes a plurality of light source units 2 and a base unit 3 to which the light source units 2 are removably mounted. In the illustrated example, the light source units 2 include three light source units 2*a*, 2*b* and 2*c* (The light source unit 2*b* is indicated by dots in FIG. 1A). The light source units 2*a*, 2*b* and 2*c* are formed into an elongated rectangular plate shape and are disposed along a straight line in a mutually adjoining relationship. The length L of each of the light source units 2*a*, 2*b* and 2*c* measured in the longitudinal direction is, e.g., about 30 cm. The base unit is formed into an elongated rectangular plate shape so that the light source units 2*a*, 2*b* and 2*c* can be collectively mounted to the base unit 3.

The light source unit 2 includes, as a light source thereof, an organic EL element 21 having a rectangular plate shape. The surface of the light source unit 2 facing the base unit 3 serves as a mounting surface 2A to be mounted to the base unit 3. The opposite surface of the light source unit 2 from the mounting surface 2A serves as a light emitting surface from which light is emitted. The light source unit 2 includes a pair of engaging portions 4 and 5 used for engagement with the base unit 3 and a pair of terminals 6 and 7 used for electric power supply and control signal input to the light source unit 2. The engaging portions 4 and 5 and the terminals 6 and 7 are disposed on the mounting surface 2A. In the illustrated example, one and the other short sides of the light source unit 2 respectively are designated by S1 and S2. The engaging portion 4 and the terminal 6 are provided in the short side S1. The engaging portion 5 and the terminal 7 are provided in the short side S2. For the sake of convenience in description, the terminal 6 and the terminal 7 are designated by different reference symbols. However, the terminals 6 and 7 are identical in function with each other.

The terminals 6 and 7 have the shape of a flat blade extending in the longitudinal direction of the light source unit 2. The terminals 6 and 7 are disposed adjacent to the engaging portions 4 and 5 in the short sides S1 and S2, respectively. The terminals 6 and 7 are erected from the mounting surface 2A. The terminal 6 includes three pole terminals, i.e., an anode terminal 61 and a cathode terminal 62 used in supplying electric power to the light source unit and a signal terminal 63 used in inputting a control signal to the light source unit 2 (see FIGS. 1B to 1E). Similarly, the terminal 7 includes three pole terminals, i.e., an anode terminal 71 and a cathode terminal 72 used in supplying electric power to the light source unit 2 and a signal terminal 73 used in inputting a control signal to the light source unit 2. The arrangement of the anode terminal 61, the cathode terminal 62 and the signal terminal 63 in the terminal 6 and the arrangement of the anode terminal 71, the cathode terminal 72 and the signal terminal 73 in the terminal 7 are in point symmetry with respect to the center C of the mounting surface 2A (see FIG. 1A). In the illustrated example, the anode terminal 61, the cathode terminal 62 and the signal terminal 63 of the terminal 6 are sequentially disposed from the inner side of the drawing sheet. The signal terminal 73, the cathode terminal 72 and the anode terminal 71 of the terminal 7 are sequentially disposed from the inner side of the drawing sheet. The arrangement of the terminals 6 and 7 is not limited to the illustrated example. The terminals 6 and 7 may be disposed in other orders as long as they are in a point symmetry relationship with each other. The control signal referred to herein includes, e.g., a dimming signal for dimming the light source unit 2. In case where the light source unit 2 includes a plurality of light emitting layers differing in light emission color from one another, the control signal individually adjust the light emission of the respective light emitting layers, thereby adjusting and controlling the colors of the irradiated light.

The surface of the base unit 3 facing the light source unit 2 serves as an attachment surface 3A to which the light source unit 2 is mounted. The opposite surface of the base unit 3 from the attachment surface 3A serves as an installation surface on which the base unit 3 is attached to an installation place of a ceiling or a wall. The base unit 3 includes holding portions 31 and 32 (indicated by dots in FIGS. 1B to 1E) which engage with the engaging portions 4 and 5 and a plurality of holding-portion-attachment portions 33 to which the holding portions 31 and 32 are detachably attached at a predetermined interval along the longitudinal direction of the base unit 3. The holding portions 31 and and the holding-portion-attachment portions 33 are disposed on the attachment surface 3A. In the illustrated example, the holding-portion-attachment portions 33 are provided at an interval of (1/4)L along the longitudinal direction and are formed of screw holes. The base unit 3 further includes a plurality of connectors 8 used in supplying electric power to the light source unit 2 and in inputting a control signal to the light source unit 2. The connectors 8 has through-holes 80 into which screws (not shown) threadedly fitted to the holding-portion-attachment portions 33 are inserted. The connectors 8 are removably fixed to the holding-portion-attachment portions 33 by the screws.

The connector 8 includes an input connector 81 which interconnects the terminal 6 of the light source unit 2*a* and an external input device, and a connector 82 which is disposed in a boundary position between the light source units 2*a* and 2*b* to electrically interconnect the light source units 2*a* and 2*b*. The connector 8 further includes a connector 83 which is disposed in a boundary position between the light source units 2*b* and 2*c* to electrically interconnect the light source units 2*b* and 2*c*, and an end cap 84 which protects the terminal 7 of the light source unit 2*c*. The input connector 81, the connectors 82 and 83 and the end cap 84 have external surfaces made of an insulating material and cover the terminals 6 and 7 such that the terminals 6 and 7 are not exposed to the outside. Accordingly, it is possible to prevent, e.g., an electric shock and a tracking phenomenon which may occur when the light source unit 2 is mounted to the base unit 3.

The input connector 81 (see FIG. 1B) includes three terminal insertion holes 81*a*, 81*b* and 81*c* into which the anode terminal 61, the cathode terminal 62 and the signal terminal 63 of the light source unit 2*a* are inserted. The terminal insertion holes 81*a*, 81*b* and 81*c* are formed such that they extend in the longitudinal direction of the base unit 3 when the input connector 81 is attached to the base unit 3. Within the terminal insertion holes 81*a*, 81*b* and 81*c*, there are provided terminal reception portions (not shown) for gripping the cathode terminal 61, the anode terminal 62 and the signal terminal 63, respectively. The input connector 81 further includes an anode line connection hole 81*d* and a cathode line connection hole 81*e* into which an anode line and a cathode line used in supplying electric power from the outside to the light source unit 2*a* are respectively inserted, and a signal line connection hole 81*f* into which a signal line used in inputting a control signal from the outside to the light source unit 2*a* is inserted. The anode line, the cathode line and the signal line inserted into the connection holes 81*d*, 81*e* and 81*f* are electrically connected to the anode terminal 61, the cathode terminal 62 and the signal terminal 63 through the terminal reception portions.

The connector 82 (see FIG. 1C) includes terminal insertion holes 82*a*, 82*b* and 82*c* into which the terminal 71, and 73 of the light source unit 2*a* are inserted, and terminal insertion holes 82*d*, 82*e* and 82*f* into which the terminals 61, 62 and 63 of the light source unit 2*b* are inserted. These terminal insertion holes 82*a* to 82*f* are formed such that they extend in the longitudinal direction of the base unit 3 when the connector 82 is attached to the base unit 3. Within the terminal insertion holes 82*a* to 82*f*, there are provided terminal reception portions (not shown) for gripping the terminals 71 to 73 and 61 to 63 inserted into the terminal insertion holes 82*a* to 82*f*, respectively. The terminal reception portion for gripping the terminal 71 and the terminal reception portion for gripping the terminal are electrically connected to each other within the connector 82. Similarly, the terminals 72 and 62 are electrically connected to each other and the terminals 73 and 63 are electrically connected to each other. That is to say, within the connector 82, the terminal reception portion for interconnecting the terminals 71 and 61, the terminal reception portion for interconnecting the terminals 72 and and the terminal reception portion for interconnecting the terminals 73 and 63 are disposed so as to intersect one another across the center of the connector 82. Thus, the light source units 2*a* and 2*b* are electrically connected to each other. The connector 83 (see FIG. 1D) is also configured just like the connector 82, whereby the light source units 2*b* and 2*c* are electrically connected to each other.

The end cap 84 includes terminal insertion holes 84*a*, 84*b* and 84*c* into which the terminals 71, 72 and 73 of the light source unit 2*c* are inserted. The terminal insertion holes 84*a*, 84*b* and 84*c* are formed such that they extend in the longitudinal direction of the base unit 3 when the end cap 84 is attached to the base unit 3. The aforementioned terminal reception portions are not installed within the terminal insertion holes 84*a*, 84*b* and 84*c*. The end cap 84 merely covers and hides the terminals 71, 72 and 73 in order to prevent an electric shock or a tracking phenomenon.

In the present embodiment, the input connector 81, the connectors 82 and 83 and the end cap 84 are one-piece formed with the holding portions 31 and/or the holding portions 32. The input connector 81 includes holding portions 31 disposed at the opposite ends thereof along a transverse direction of the base unit 3 when the input connector 81 is attached to the base unit 3. Each of the connectors 82 and 83 includes holding portions 31 and 32 disposed at each of the opposite ends thereof along the transverse direction of the base unit 3. The holding portions 31 and 32 disposed at each of the opposite ends are provided as one piece. The end cap 84 includes holding portions 32 disposed at the opposite ends thereof along the transverse direction of the base unit 3. By unifying the connector 8 and the holding portions 31 and 32 in this way, it is possible to reduce the number of parts that constitute the light emitting module 1, thereby enhancing the assembling efficiency.

Figure 2A:
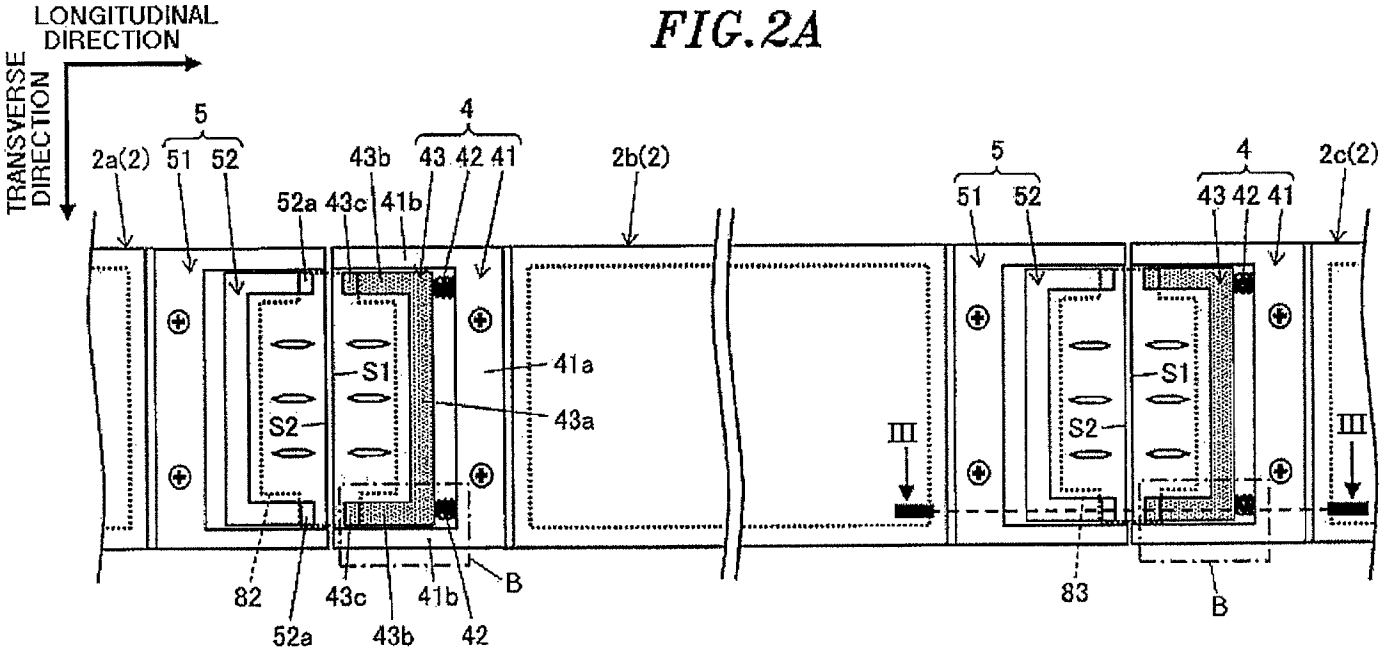
FIG. 2A is a plan view of light source units that constitute the light emitting module.

As shown in FIG. 2A, the engaging portion 4 includes a fixing portion 41 screw-fixed to a body of the light source unit 2. The fixing portion 41 is formed into a substantially C-like plate shape when seen in a plan view. The fixing portion 41 includes a base portion 41*a* extending along the transverse direction of the light source unit 2 and a pair of arm portions 41*b* extending toward the short side S1 along the longitudinal direction of the light source unit 2. The engaging portion 4 further includes a pair of springs 42 each having one end fixed to the base portion 41*a* of the fixing portion 41 and extending toward the short side S1, and a claw portion 43 (indicated by dots) attached to the other ends of the springs 42 and directly engaging with the holding portions 31.

The claw portion 43 is formed into a substantially C-like plate shape with a size smaller than the fixing portion and is disposed in a region surrounded by the base portion 41*a* and the arm portions 41*b* of the fixing portion 41. The claw portion 43 includes a base portion 43*a* extending parallel to the base portion 41*a* of the fixing portion 41, a pair of arm portions 43*b* extending from the opposite ends of the base portion 43*a* toward the short side S1, and a pair of claws 43*c* provided at the distal ends of the arm portions 43*b* and engaging with the holding portions 31.

Figures 2B, 2C:
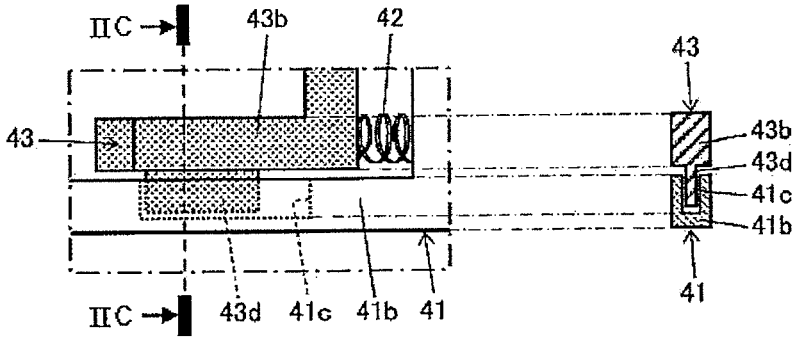
FIG. 2B is an enlarged view of a region B surrounded by a single-dot chain line in FIG. 2A.
FIG. 2C is a sectional view taken along line IIC-IIC in FIG. 2B.

As shown in FIGS. 2B and 2C, the claw portion 43 further includes a plate-shaped slide portion 43*d* extending transversely outward from each of the arm portions 43*b*. The slide portion 43*d* is slidably inserted into a slide groove 41*c* which is formed by cutting the surface of each of the arm portions 41*b* facing the claw portion 43. Thus, the claw portion 43 is elastically biased toward the short side S1 by the springs 42. When a force acting against the biasing force of the springs 42 is applied to the claw portion 43, the claw portion 43 slides away from the short side S1 (toward the engaging portion 5 of one light source unit 2) within an extent in which the slide portion 43*d* can slide along the slide groove 41*c*.

As shown in FIG. 2A, the engaging portion 5 includes a fixing portion 51 and a claw portion 52 which are identical in shape with the fixing portion 41 and the claw portion 43 of the engaging portion 4. The claw portion 52 is fixed to the body of the light source unit 2. The claw portion 43 includes claws 52*a* which are identical in shape with the claws 43*c* of the engaging portion 4. The claws 52*a* engage with the holding portions 32.

Each of the connectors 82 and 83 is formed to have substantially the same thickness as the thickness of the engaging portions 4 and 5 and is disposed in a region surrounded by the claw portion 43 of the engaging portion 4 and the claw portion 52 of the engaging portion 5. While not shown in the drawings, the input connector 81 is disposed in a region surrounded by the claw portion 43 of the light source unit 2*a*. The end cap 84 is disposed in a region surrounded by the claw portion 52 of the light source unit 2*c*.

Figure 3:
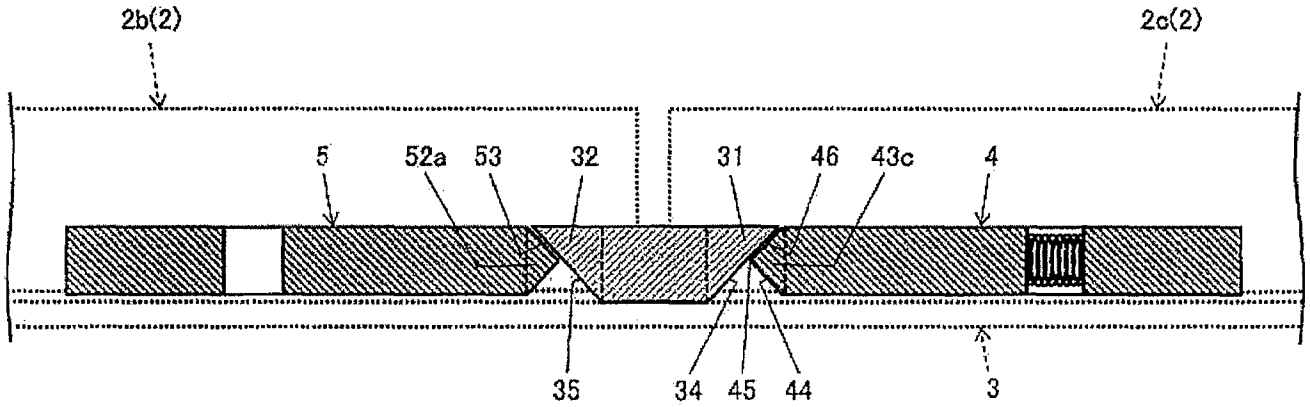
FIG. 3 is a sectional view taken along line III-III in FIG. 2A.

FIG. 3 shows a state in which the engaging portions 4 and 5 and the holding portions 31 and 32 engage with each other. The claw 43*c* of the engaging portion 4 is formed into a V-like shape pointed toward the holding portion 31. The claw 43*c* includes a slant surface 44 facing the base unit 3 and an engaging surface 46 disposed at the opposite side of an apex portion 45 from the slant surface 44 and configured to engage with the holding portion 31. The claw 52*a* of the engaging portion 5 includes an engaging surface 53 which engages with the holding portion 32.

The holding portion 31 includes an engaging surface 34 formed to have the same inclination angle as that of the engaging surface 46 of the engaging portion 4 and configured to engage with the engaging portion 4. The holding portion 32 has the same shape as the holding portion 31 and includes an engaging surface 35 formed to have the same inclination angle as that of the engaging surface 53 of the engaging portion 5 and configured to engage with the engaging portion 5.

Figure 4A:
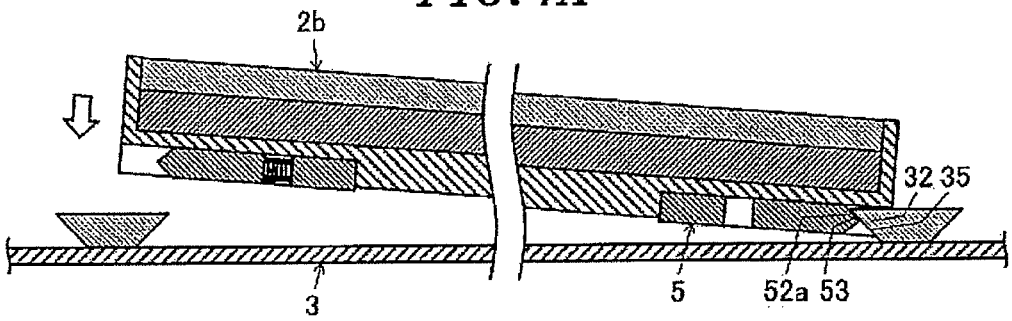
FIGS. 4A to 4D are side sectional views illustrating the operations performed when the light source unit is mounted to the base unit.
Figure 4B:
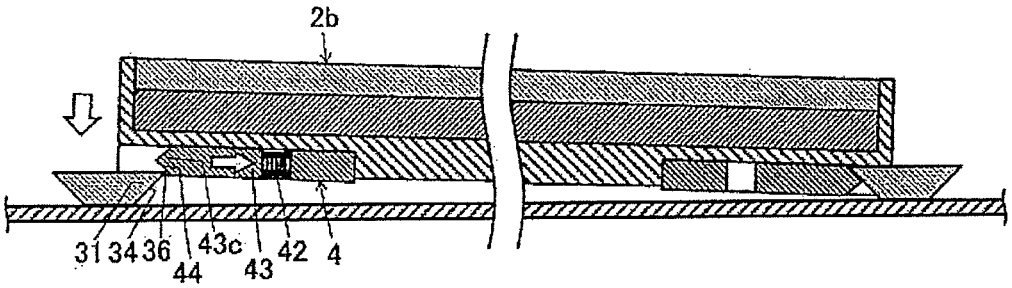
Figure 4C:
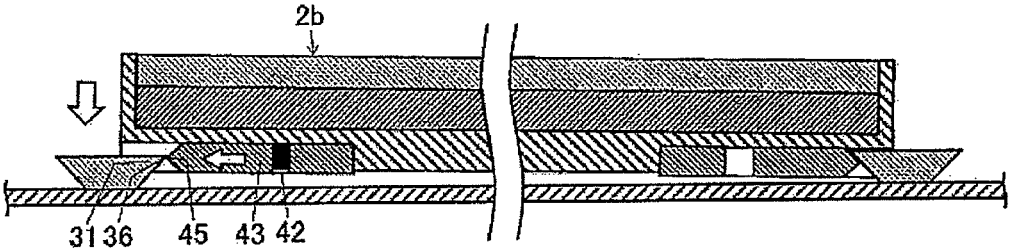
Figure 4D:
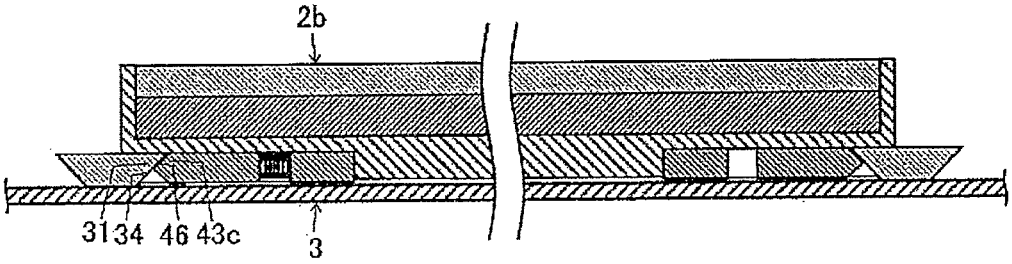

The operations of mounting the light source unit 2*b* to the base unit 3 in the light emitting module 1 configured as above will be described with reference to FIGS. 4A to 4D. First, as shown in FIG. 4A, the claw 52*a* of the engaging portion 5 and the holding portion 32 are brought into engagement with each other through the engaging surfaces 53 and 35 thereof. In this state, the light source unit 2*b* is rotated toward the base unit 3 about the engaging position. Thus, as shown in FIG. 4B, the claw 43*c* of the engaging portion 4 makes contact with the end portion 36 of the engaging surface 34 of the holding portion 31 through the slant surface 44 thereof. Consequently, the slant surface 44 is pressed against the end portion 36, thereby generating a force by which the claw portion 43 of the engaging portion 4 is moved inward of the light source unit 2*b* against the biasing force of the springs 42. Then, as shown in FIG. 4C, at the time point at which the apex portion 45 of the claw portion 43 moved inward of the light source unit 2*b* goes over the end portion 36 of the holding portion 31, the claw portion 43 is moved outward of the light source unit 2*b* by the biasing force of the springs 42. As a result, as shown in FIG. 4D, the claw 43*c* and the holding portion 31 engage with each other through the engaging surfaces 46 and 34, whereby the light source unit 2*b* is mounted to the base unit 3. As set forth above, in the light emitting module 1, the force by which the light source unit 2*b* is rotated toward the base unit 3 is converted to the force by which the slant surface 44 of the claw portion 43 is pressed against the end portion 36 of the holding portion 31 to thereby move the claw portion 43 inward of the light source unit 2*b*. While not shown in the drawings, the mounting of the light source units 2*a* and 2*c* to the base unit 3 is performed in the same manner as the mounting of the light source unit 2*b* to the base unit 3.

Figure 5:
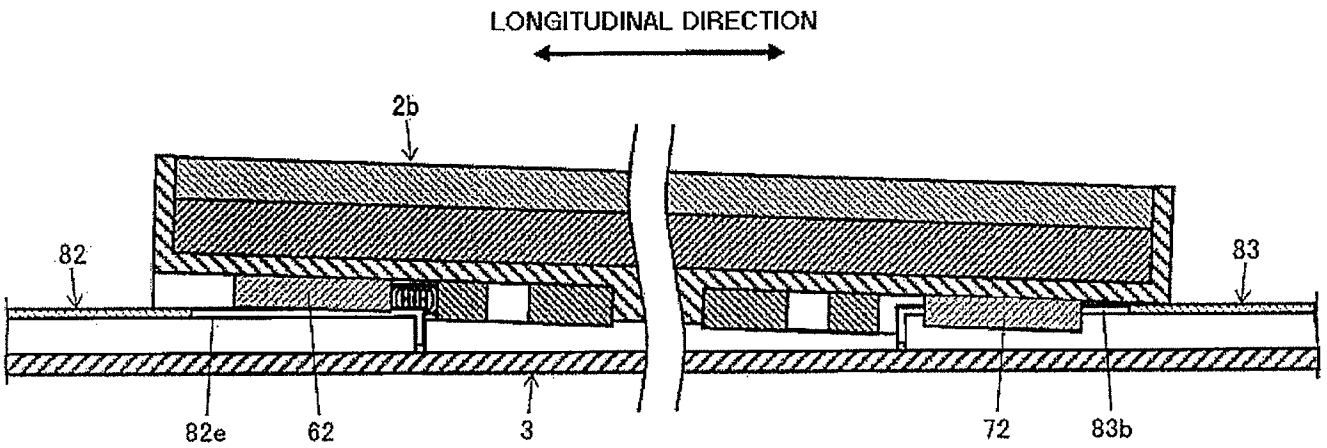
FIG. 5 is a side sectional view illustrating how to insert a terminal into an insertion hole when the light source unit is mounted to the base unit.

As shown in FIG. 5, simultaneously with the mounting of the light source unit 2*b* to the base unit 3 which is performed in the aforementioned manner, the cathode terminals 62 and 72 of the light source unit 2*b* are respectively inserted into the terminal insertion hole 82*e* of the connector 82 and the terminal insertion hole 83*b* of the connector 83. At this time, even if the light source unit 2*b* is slightly misaligned along the longitudinal direction of the base unit 3, the cathode terminals 62 and 72 do not interfere with the terminal insertion holes 82*e* and 83*b*. This is because the cathode terminals 62 and 72 and the terminal insertion holes 82*e* and 83*b* are formed along the longitudinal direction of the base unit 3 (the slide direction of the engaging portion 4). This makes it possible to prevent damage of the terminals 62 and 72 during the mounting of the light source unit 2*b* to the base unit 3, thereby enhancing the reliability of the light emitting module 1. While not shown in the drawings, the foregoing description holds true with respect to the remaining terminals 61, 63, 71 and 73 of the light source unit 2*b*. In addition, the foregoing description holds true with respect to the terminals 6 and 7 of the light source unit 2*a* and the terminals 6 and 7 of the light source unit 2*c*.

As described above, according to the light emitting module 1 of the present embodiment, the connector 8 unified with the holding portions 31 and 32 for holding the light source units 2 is detachably attached to an arbitrary holding-portion-attachment portion 33. Thus, by changing the arrangement of the holding portions 31 and 32, it is possible to change the arrangement of the light source units 2 at an interval of (1/4)L along the longitudinal direction of the base unit 3. This makes it possible to easily and accurately dispose the light source units 2 at arbitrary locations.

In a hypothetical case where the engaging portions 4 and 5 and the holding portions 31 and 32 are provided in the long sides of the light source units and the base unit 3, the long sides (about 30 cm) of the light source units 2 and the long side of the base unit 3 need to be accurately aligned with each other in order to bring the engaging portions 4 and 5 into engagement with the holding portions 31 and 32. This aligning operation is sometimes difficult to perform, for example, if the light source units 2 are heavy or if the long sides of the light source units 2 become longer. In contrast, in the light emitting module 1, the engaging portions 4 and 5 and the holding portions 31 and 32 are provided in the short sides of the light source units 2 and the base unit 3. It is therefore possible to easily bring the engaging portions 4 and 5 into engagement with the holding portions 31 and 32, thereby enhancing the operability.

Figure 6A:
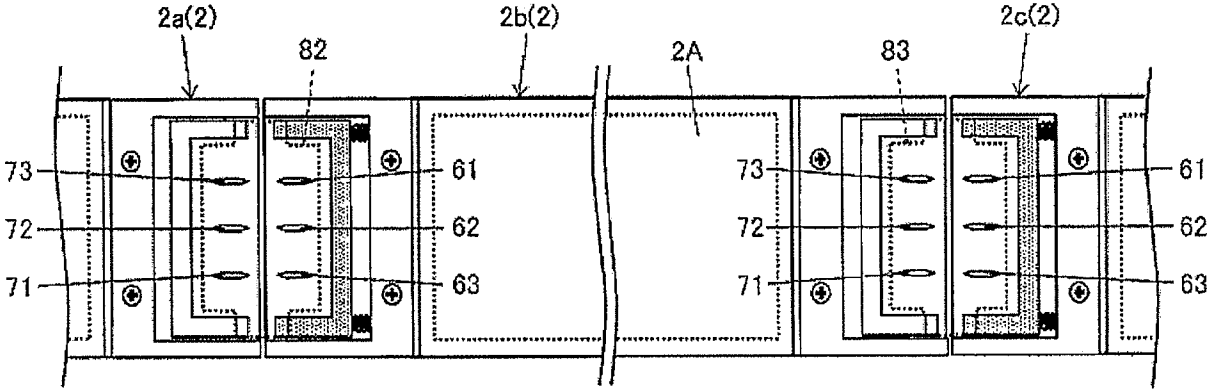
FIGS. 6A and 6B are plan views showing the mounting direction of the light source units to the base unit.
Figure 6B:
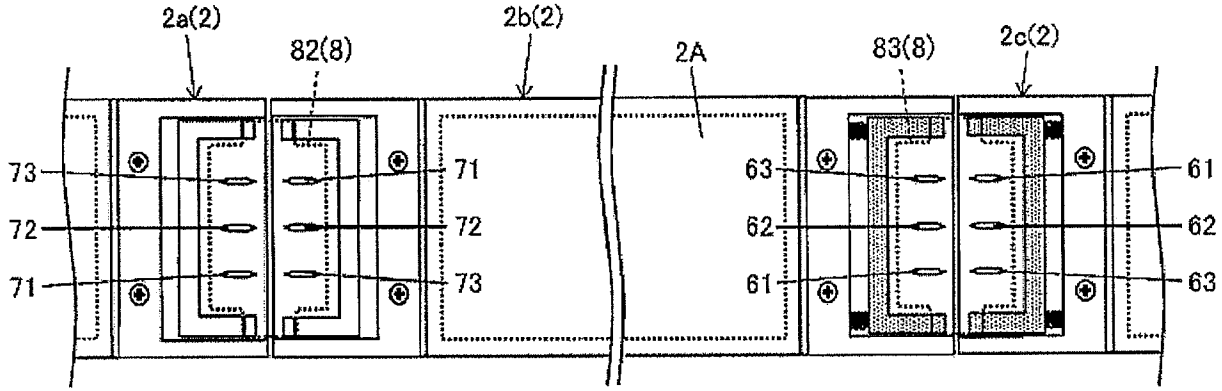

The claw 43*c* of the engaging portion 4 is identical in shape with the claw 52*a* of the engaging portion 5. The holding portions 31 and 32 are also identical in shape with each other. Therefore, as shown in FIGS. 6A and 6B, the light source unit 2*b* can be mounted by inverting the same 180 degrees. At this time, in the light source unit 2*b*, the arrangement of the anode terminal 61, the cathode terminal and the signal terminal 63 and the arrangement of the cathode terminal 71, the cathode terminal 72 and the signal terminal 73 are in point symmetry with respect to the center C of the mounting surface 2A. For that reason, even if the light source unit 2*b* is mounted to the base unit 3 in a 180-degree-inverted state, the connector 82 can connect the anode terminal 71, the cathode terminal 72 and the signal terminal 73 of the light source unit 2*a* to the anode terminal 71, the cathode terminal 72 and the signal terminal 73 of the light source unit 2*b*. Furthermore, the connector 83 can connect the anode terminal 61, the cathode terminal 62 and the signal terminal 63 of the light source unit 2*b* to the anode terminal 61, the cathode terminal 62 and the signal terminal 63 of the light source unit 2*c*. Similarly, even if the light source units 2*a* and 2*c* are mounted to the base unit 3 in a 180-degree-inverted state, the terminals thereof are accurately connected to each other. Likewise, the light source units 2*a*, 2*b* and 2*c* are accurately electrically connected to one another at all times regardless of the mounting direction of the light source units 2*a*, 2*b* and 2*c* to the base unit 3. It is therefore possible to enhance the operability when the light source units 2*a*, 2*b* and 2*c* are mounted to the base unit 3.

Figure 7:
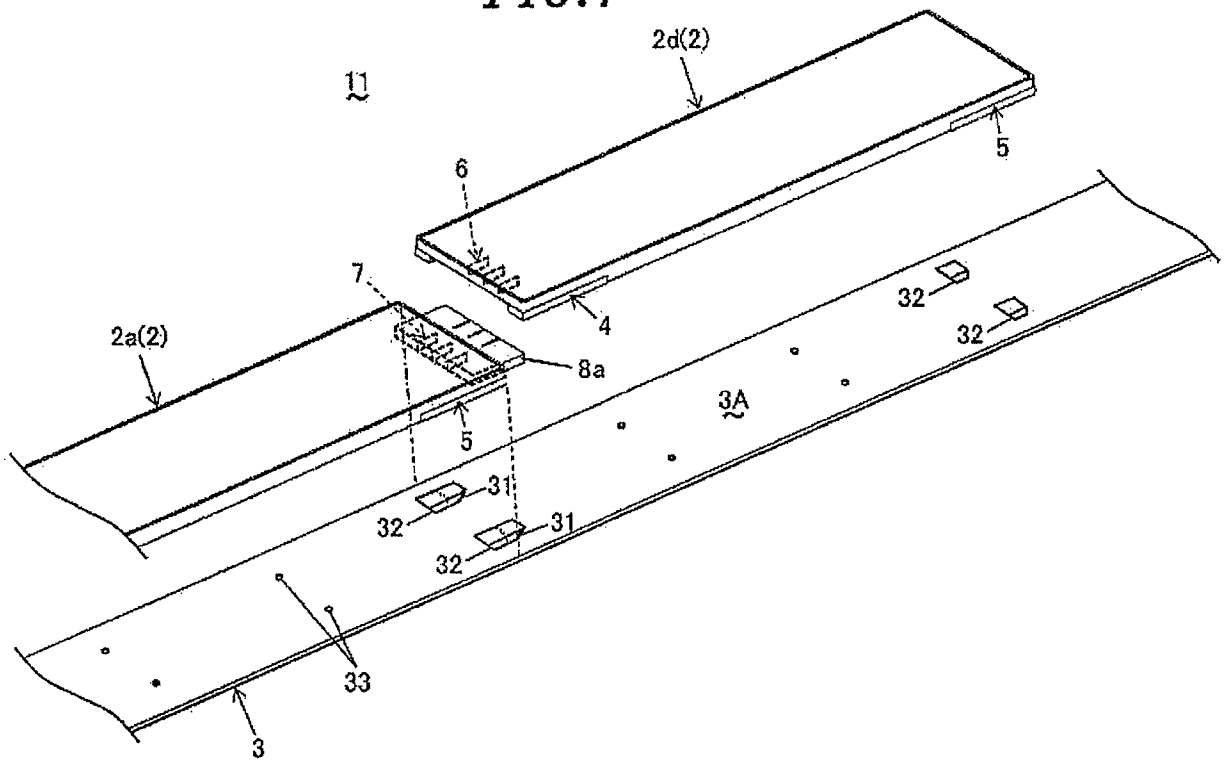
FIG. 7 is an exploded perspective view of a light emitting module according to another embodiment.
Figure 8:
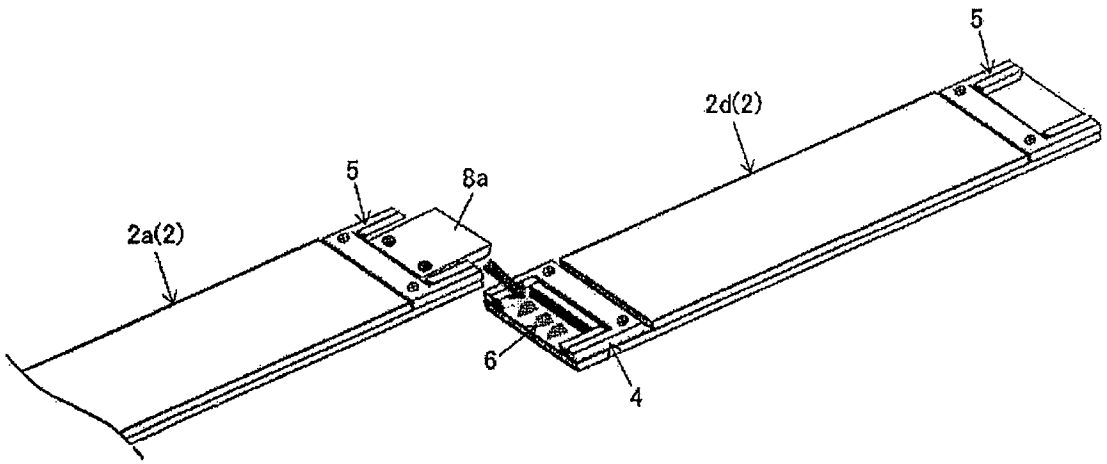
FIG. 8 is a perspective view of light source units that constitute the light emitting module shown in FIG. 7.

Next, a light emitting module according to another embodiment will be described with reference to FIGS. 7 and 8. In the light emitting module 11, the holding portions 31 and 32 are separated from the connector 8*a*. The connector 8*a* is attached to one of the terminals 6 and 7 before the light source unit 2 mounted to the base unit 3.

In the illustrated example, the light source units 2*a* and 2*d* are mounted to the base unit 3 in such a state that the light source units 2*a* and 2*d* are disposed along a straight line in a mutually adjoining relationship. In this regard, the light source unit 2*a* is identical with the light source unit 2*a* of the aforementioned light emitting module 1. The light source unit 2*d* differs from the aforementioned light source unit 2*b* in that the light source unit 2*d* is provided with only the terminal 6 with the terminal 7 removed. The light source unit 2*d* is positioned at the end of an electric circuit which interconnects the light source units 2.

On the attachment surface 3A of the base unit 3 corresponding to the boundary position of the light source units 2*a* and 2*d*, a pair of holding portions 32 engaging with the engaging portion 5 of the light source unit 2*a* and a pair of holding portions 31 engaging with the engaging portion 4 of the light source unit 2*d* are respectively attached to the holding-portion-attachment portions 33. The holding portions 31 and 32 adjoining each other are unified with each other and are formed into a single member. At the location of the attachment surface 3A corresponding to the engaging portion 5 of the light source unit 2*d*, a pair of holding portions 32 is attached to the holding-portion-attachment portions 33. In addition, the aforementioned connector 8*a* is fixed to the light source unit 2*a* in such a state that the connector 8*a* is connected to the terminal 7 of the light source unit 2*a*.

The light emitting module 11 configured as above provides the same effects as provided by the aforementioned light emitting module 1. In addition, the connector 8*a* is fixed to the light source unit 2*a*. Therefore, if the light source unit 2*d* is connected to the connector 8*a*, it is possible to electrically interconnect the light source units 2*a* and 2*d* without having to mount the light source units 2*a* and 2*d* to the base unit 3. Moreover, the light source unit 2*d* positioned at the end of an electric circuit is not provided with the terminal 7. Therefore, it is not necessary to dispose the end cap 84. As a result, the number of component parts is reduced as compared with the aforementioned light emitting module 1. This makes it possible to reduce the price of the light emitting module 11 and to enhance the assembling efficiency thereof.

The light emitting module according to the present invention and the illumination device using the same are not limited to the embodiments described above but may be modified in many different forms. For example, a pair of engaging portions may be configured to slide together toward other engaging portions. Moreover, a plurality of light source units may differ in longitudinal length from one another. At this time, it is preferred that the longitudinal length of each of the light source units is an integer multiple of the spacing between the holding-portion-attachment portions.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A light emitting module, comprising:

a plurality of light source units having a rectangular plate shape; and a base unit having an elongated rectangular plate shape, the light source units disposed along a straight line and removably mounted to the base unit, wherein each of the light source units includes a pair of engaging portions used in bringing each of the light source units into engagement with the base unit, the engaging portions disposed in two opposite sides of a mounting surface of each of the light source units to be mounted to the base unit, at least one of the engaging portions is slidable toward the other engaging portion, and the base unit includes a plurality of holding portions provided along a longitudinal direction of the base unit on an attachment surface of the base unit to which the light source units are attached and a plurality of holding-portion-attachment portions to which the holding portions are detachably attached at a predetermined interval along the longitudinal direction of the base unit.

2. The light emitting module of claim 1, wherein each of the light source units further includes terminals erected from the mounting surface in an adjoining relationship with the engaging portions and used in supplying electric power to each of the light source units and inputting a control signal to each of the light source units, the base unit further includes a plurality of connectors electrically connected to the terminals and detachably attached to the holding-portion-attachment portions, and the connectors are provided adjacent to the light source units and disposed in boundary positions between the light source units when the light source units are mounted to the base unit in an adjoining relationship with each other, and the connectors interconnect the terminals of the light source units adjoining each other.

3. The light emitting module of claim 2, wherein the holding portions are unified with each of the connectors.

4. The light emitting module of claim 3, wherein each of the terminals has a shape of a flat blade extending in a slide direction of the engaging portions, each of the connectors has terminal insertion holes into which the terminals are inserted, and the terminal insertion holes are formed so as to extend along the longitudinal direction of the base unit.

5. The light emitting module of claim 4, wherein the terminals are disposed at the sides of each of the light source units in which the engaging portions are provided.

6. The light emitting module of claim 5, wherein the terminals are composed of three pole terminals which include an anode terminal and a cathode terminal used in supplying electric power to each of the light source units and a signal terminal used in inputting a control signal to each of the light source units, and in each of the light source units, the arrangement of the three pole terminals existing in one side and an arrangement of the three pole terminals existing in the other side are in point symmetry with respect to a center of the mounting surface.

7. The light emitting module of claim 2, wherein each of the terminals has a shape of a flat blade extending in a slide direction of the engaging portions, each of the connectors has terminal insertion holes into which the terminals are inserted, and the terminal insertion holes are formed so as to extend along the longitudinal direction of the base unit.

8. The light emitting module of claim 3, wherein the terminals are disposed at the sides of each of the light source units in which the engaging portions are provided.

9. The light emitting module of claim 8, wherein the terminals are composed of three pole terminals which include an anode terminal and a cathode terminal used in supplying electric power to each of the light source units and a signal terminal used in inputting a control signal to each of the light source units, and in each of the light source units, the arrangement of the three pole terminals existing in one side and an arrangement of the three pole terminals existing in the other side are in point symmetry with respect to a center of the mounting surface.

10. The light emitting module of claim 7, wherein the terminals are disposed at the sides of each of the light source units in which the engaging portions are provided.

11. The light emitting module of claim 2, wherein the terminals are disposed at the sides of each of the light source units in which the engaging portions are provided.

12. The light emitting module of claim 10, wherein the terminals are composed of three pole terminals which include an anode terminal and a cathode terminal used in supplying electric power to each of the light source units and a signal terminal used in inputting a control signal to each of the light source units, and in each of the light source units, the arrangement of the three pole terminals existing in one side and an arrangement of the three pole terminals existing in the other side are in point symmetry with respect to a center of the mounting surface.

13. The light emitting module of claim 11, wherein the terminals are composed of three pole terminals which include an anode terminal and a cathode terminal used in supplying electric power to each of the light source units and a signal terminal used in inputting a control signal to each of the light source units, and in each of the light source units, the arrangement of the three pole terminals existing in one side and an arrangement of the three pole terminals existing in the other side are in point symmetry with respect to a center of the mounting surface.

14. The light emitting module of claim 2, wherein the connectors are attached to the terminals before the light source units are mounted to the base unit.

15. The light emitting module of claim 14, wherein the holding portions and the connectors are separately provided.

16. An illumination device comprising:

the light emitting module of claim 1.

* * * * *